US006371295B1

(12) United States Patent
Mayer et al.

(10) Patent No.: US 6,371,295 B1
(45) Date of Patent: Apr. 16, 2002

(54) PAPER BOOKLET FOR LIPSTICK IMPRINT RECORDING AND METHOD OF USING SAME

(76) Inventors: Melissa A. Mayer; Robyn M. Dunn, both of 3411 Park Blvd., San Diego, CA (US) 92103

( * ) Notice: Subject to any disclaimer, the term of this patent is extended or adjusted under 35 U.S.C. 154(b) by 0 days.

(21) Appl. No.: 09/737,974

(22) Filed: Dec. 15, 2000

(51) Int. Cl.[7] ..... B65D 85/00
(52) U.S. Cl. ..... 206/450; 206/232; 206/459.5
(58) Field of Search ..... 206/450, 232, 206/449, 451, 459.5, 823, 494; 132/200

(56) References Cited

U.S. PATENT DOCUMENTS

| | | | | | |
|---|---|---|---|---|---|
| 226,930 | A | * | 4/1880 | Richardson | 206/451 |
| 460,472 | A | * | 9/1891 | Hitt | 206/450 |
| 1,350,203 | A | * | 8/1920 | Abbott | 206/451 |
| 1,873,610 | A | * | 8/1932 | Lyon | 225/27 |
| 1,885,076 | A | * | 10/1932 | Bustamante | 206/451 |
| 2,157,740 | A | * | 5/1939 | Quinlan | 206/232 |
| 2,803,338 | A | * | 8/1957 | Elliott | 206/232 |
| 6,035,867 | A | * | 3/2000 | Barrick | 206/823 |

OTHER PUBLICATIONS

"TWA Lipstick tissues from the 1960s" , 1960, http://cgi.ebay.com/aw–cgi/eBayISAPI.dll?ViewItem&item=1129364193.*

"Book of Kisses" , upload Apr. 1999, Mrs. Bee's Busy Classroom Web Page, http://www.geocities.com/Heartland/Lake/4482/motherday.htm.*

* cited by examiner

*Primary Examiner*—Eduardo C. Robert
(74) *Attorney, Agent, or Firm*—Foley & Lardner; Benard L. Kleinke

(57) ABSTRACT

A device for removing excess lipstick or for recording lipstick usage, includes a plurality of sheets suitable for receiving and retaining a clear lip-shaped lipstick imprint when the paper is "kissed". Each of the sheets of paper being composed of papers of sufficient hardness to retain clearly a lip-shaped lipstick imprint without removing an excessive amount of lipstick from the lips of the user.

24 Claims, 2 Drawing Sheets

PAPER BOOKLET FOR LIPSTICK IMPRINT RECORDING AND METHOD OF USING SAME

RELATED ART

Small booklets of soft tissue paper generally in the shape of a match booklet are well known in the art (see U.S. Pat. No. 1,518,628 to Wood; and U.S. Pat. No. 1,873,610 and 2,029,245 to Lyon). These booklets contain facial-type tissue paper that is soft in texture and relatively thick, such as the KLEENEX® brand of facial tissue. The softness and generally high absorbent character of these tissues renders them suitable for wiping purposes including shaping and removal of excess makeup and for cleaning purposes such as for cleaning eyeglasses. Facial-type tissue is effective at removing lipstick stains from sources such as the hand and fingers, but is prone to removing too much lipstick from the lips when used for blotting and can leave pieces of the tissue on the lips. Lipstick blotting on facial-type tissue entails "biting down" on the tissue, which removes excess lipstick from the inner portions of the lips only. After such removal, the used tissues were discarded. Thus, the facial-type tissues that were used in booklets of the prior art were essentially a source of disposable handkerchiefs of conveniently small size.

SUMMARY OF THE INVENTION

The present invention provides a device for removing excess lipstick or for recording lipstick usage, includes a plurality of sheets suitable for receiving and retaining a clear lip-shaped lipstick imprint when the paper is "kissed". Each of the sheets of paper being composed of papers of sufficient hardness to retain clearly a lip-shaped lipstick imprint without removing an excessive amount of lipstick from the lips of the user.

BRIEF DESCRIPTION OF THE DRAWINGS

The various features and advantages of the present invention will become more clearly appreciated as a detailed description of the preferred embodiment is given with reference to the appended drawings in which.

DETAILED DESCRIPTION OF THE PREFERRED EMBODIMENTS

The present invention includes methods and constructions for using a paper booklet of the present invention to facilitate recording lipstick usage in a convenient manner. The inventive technique includes the steps of (a) applying lipstick to the lips; (b) opening the paper booklet so as to expose a sheet of paper; and (c) kissing the sheet of paper, thereby leaving a lip-shaped lipstick imprint. Although usually not a problem, it is helpful that the person apply sufficient lipstick to the lips in order to have excess available to form an imprint on the paper. The present invention contemplates that the lip-printed sheets or pages remain in tact in a booklet form for record keeping purposes, but is also contemplates selectively removing of the imprinted pages to serve as a novel reminder document or greeting card as hereinafter described in detail.

Figure 1:
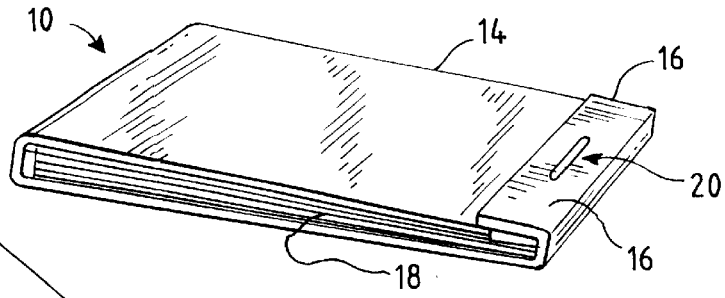
FIG. 1 is a pictorial view of a paper booklet, which is constructed in accordance with the present invention, an which is illustrated in the closed position.

FIGS. 1–7 show various embodiments of the invention. FIG. 1 is a pictorial view of a paper booklet 10 constructed according to the present invention. The paper booklet 10 shown in FIG. 1 adopts the shape and look of a match book and includes a flexible backing member 12 having an integral cover portion 14 which folds over and covers the top of the booklet when folded into engagement with overlapped reversely bent portion 16, which is also an extension of backing member 12. Sheets of paper generally indicated at 18 are retained within paper booklet 10 by a staple 20, or other suitable fastening devices for retaining the paper within the booklet such as clips.

The paper booklet is preferably of small size to allow easy transportation and storage while being large enough for the lip print of a large user. A preferred size is slightly longer and about the same width as a typical matchbook. For example, the preferred dimensions are about 3 inches long by about 1 and ⅞ inches wide. The booklet 10 preferably contains about 30 sheets of paper indicated at 18, although a smaller or larger number of sheets can easily be accommodated.

It is preferable both in terms of convenience and functionality if the paper sheets are attached to the flexible backing member 12 such as shown in FIG. 1. The flexible backing member 12 preferably is prepared from a flexible material such as paper stock or plastic but could also be made of metal materials such as aluminum. Alternatively, the sheets of paper can be provided in the form of a tablet of paper or as individual sheets in a container device such as a box. In addition, the paper for making lipstick imprints may be in the form of a roll provided preferably with the ability to detach sections of paper containing a lip imprint.

The paper for making lipstick imprints has several characteristics, including the capacity to make a clear lipstick imprint when the paper is "kissed," without regard to the lipstick composition. The paper also can remove a suitable amount of lipstick from the lips when used to blot excess lipstick. In addition, the paper is preferably of sufficient weight and caliper to enable the user to easily "thumb" through the pages of the booklet when looking for a particular blot. Facial-type tissue paper does not provide these characteristics. Also, paper with high cotton fiber content is generally unsatisfactory.

The paper for lipstick blotting preferably has a blue white matte finish with a gloss (specular gloss at 75° angle) of less than about 50%, more preferably, less than about 30%, and most preferably about 18% or less. The paper has a basis weight (lbs./500 sheet, 25×38) preferably between about 40 pounds to about 80 pounds, more preferably between about 50 pounds to about 70 pounds and most preferably about 60 pounds. The brightness or reflectance of the paper (D65 illumination) is preferably greater than about 70%, more preferably greater than about 80%, and most preferably about 90% or more. The opacity of the paper (i.e. percent of non-transmittance) is preferably about 70%, more preferably greater than about 80%, and most preferably 93% or more. The caliper of the paper (mils or thousands of an inch) is preferably about 0.0025 to about 0.0045, more preferably about 0.0030 to about 0.0040, and most preferably about 0.0034. A preferred paper is Utopia Two, a blue white matte finish paper, available from Appleton Paper Co, Kimberly Wis. The preferred characteristics of Utopia Two include a 60 pound basis weight, brightness (D65) of 90%, opacity of 93%, spectral gloss (75°) of 18 and a caliper of 0.0034 mils.

The dimensional characteristics of the paper used for making the lipstick are not critical. It is preferred that the paper be of sufficient dimension to allow it to be held upright in the palm of the hand and kissed (see FIG. 3). A convenient paper size for this purpose is about 3 inches long and about 1–2 inches wide, more preferably about 1 and ⅞ inches wide. If the paper includes perforations for removal, the perforations would be applied about ½ inch from the long end of the sheet.

Figure 2:
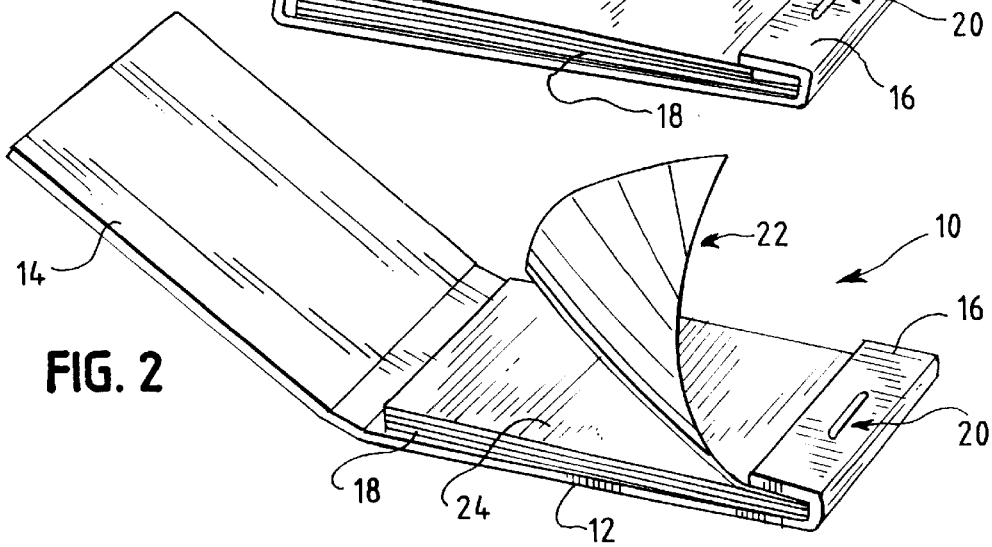
FIG. 2 is a pictorial view of the paper booklet of FIG. 1 with the cover opened and with a protective cover sheet shown partially uplifted.

FIG. 2 is a pictorial view showing the paper booklet 10 with the cover 14 opened. Inside paper booklet 10 is a non-removable protective cover sheet 22, which overlays paper sheets 18, and which when lifted and bent backwardly, exposes the surface of the top paper sheet 24 FIG. 2 indicates the sheet 22 in the process of being bent backwardly. The cover sheet 22 provides hygienic protection by allowing a person to open the cover of the packet and avoid touching a prior lipstick blot on the topmost sheet retained in the booklet 10. The cover sheet 22 preferably does not absorb or disturb the lipstick imprint on the topmost sheet 24 of paper directly below the cover sheet. The protective cover sheet may be of a transparent nature and may be colored. A preferred protective cover sheet is CROMATICA® Absinthe (Thibierge Comar Papetiers, NY), which is made from paper fiber. The paper of which the sheet 22 is composed, is partially transparent, and has a frosted finish, with a basis weight of 27 pounds and a caliper of 0.0034 mils. The protective cover sheet 22 also may be made from cotton fiber paper such as used in vellum or from polymeric film such as polyethylene or polypropylene.

Figure 3:
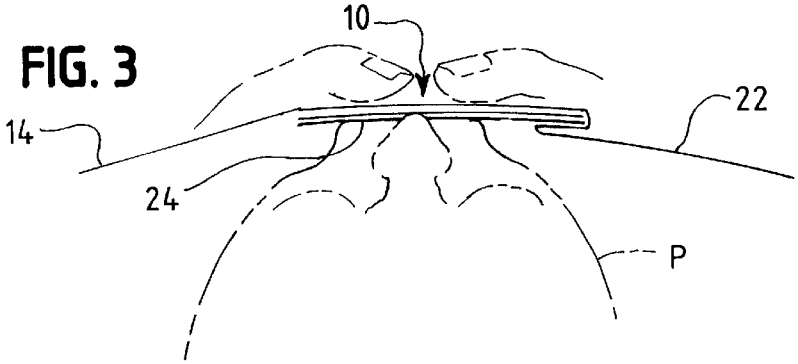
FIG. 3 is a top view of the paper booklet of FIG. 1 in a hand-held position suitable for making a lipstick blot by "kissing the surface of an exposed sheet of paper of the booklet.

FIG. 3 is a top view of the paper booklet 10, showing how the paper booklet assembly is held by a person P when preparing to apply a lipstick imprint to the paper in accordance with the present invention. The paper booklet 10 is held between the thumb and forefingers of each hand as shown. The top cover 14 is held in the opened position with one hand, and the protective cover 22 is folded back to expose the surface of the paper sheet close to the mouth. The individual having previously applied lipstick then "kisses" the paper to form the blot or imprint.

Figure 4:
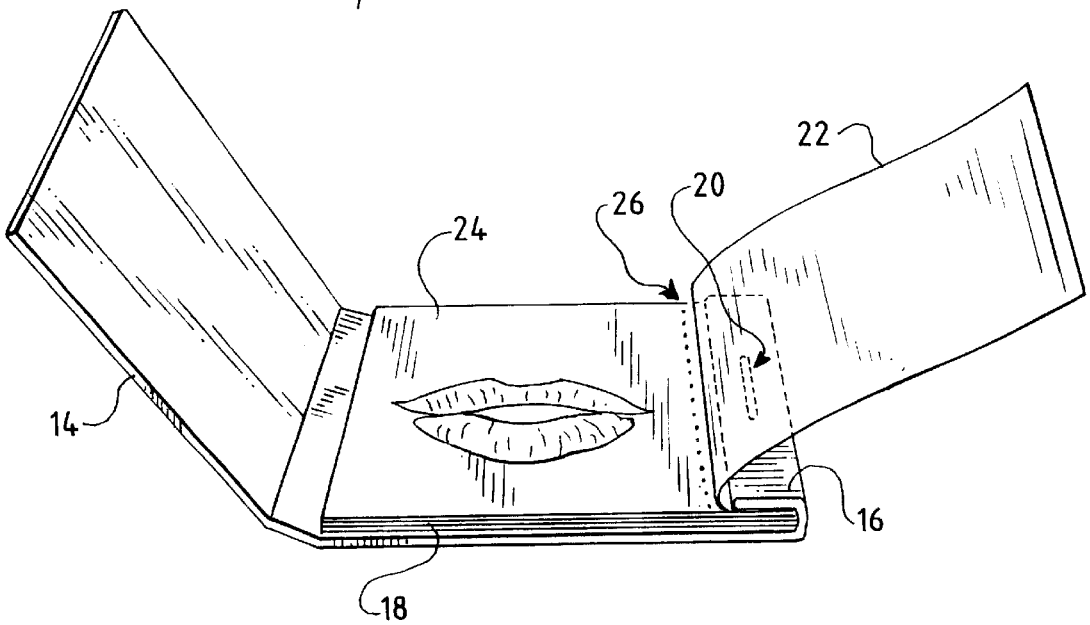
FIG. 4 is a pictorial view of the paper booklet of FIG. 1 with the cover opened, revealing a lipstick imprint on the surface of a paper sheet.

As shown in FIG. 4, the top cover 14 is open and protective sheet 22 is lifted back, exposing top paper sheet 24 shown with a lipstick imprint thereon. Paper sheets have a line of perforations 26 to allow easy removal of a sheet from the assembly, if desired, by tearing the sheet along the perforations. Alternatively, paper sheets can be removed by tearing them along a solid edge (not shown) of material (e.g., paper, plastic or metal), which is attached across the paper approximately at the position shown by perforations 26 in FIG. 4.

It should be understood that in accordance with the present invention, the user can alternatively retain some or all of the sheets 18 in the booklet 10 as record of previous lip-shaped lipstick imprints.

Figure 5:
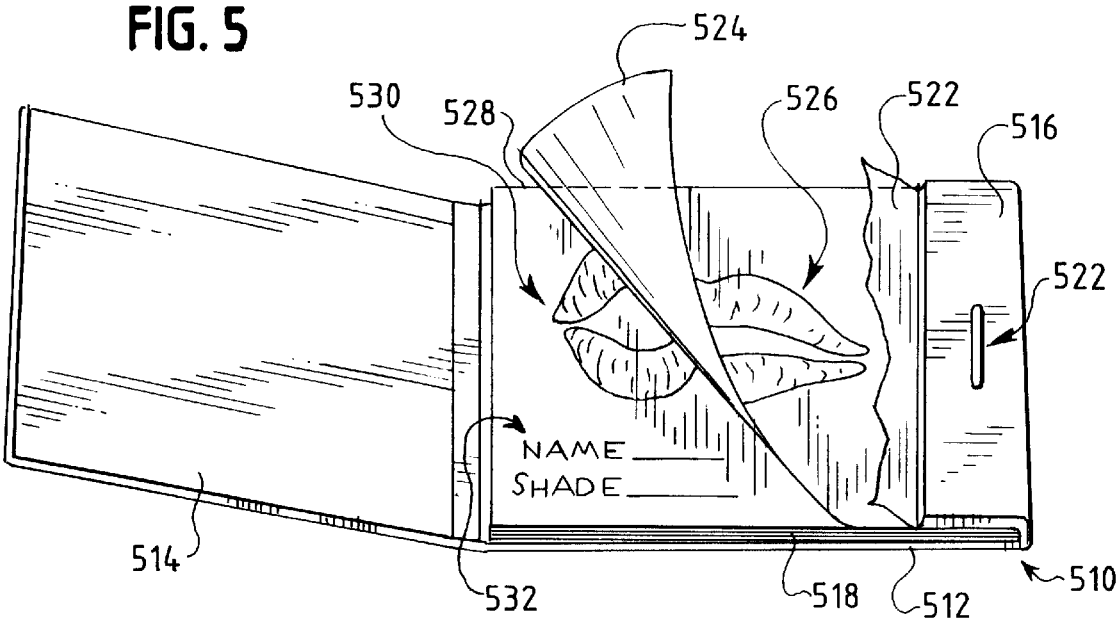
FIG. 5 is a pictorial view of another paper booklet, which is also constructed according to the present invention, and which is shown with the cover opened, revealing a lipstick imprint on the surface of multiple paper sheets in the packet and revealing indicia on the sheets for recording indicia about the imprint.
Figure 6:
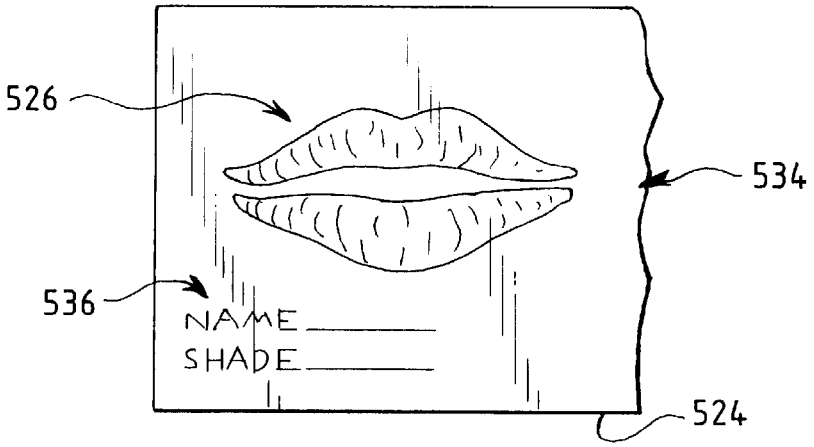
FIG. 6 is a pictorial view of the front face of a sheet of paper which has been removed from the paper booklet shown in FIG. 5.
Figure 7:
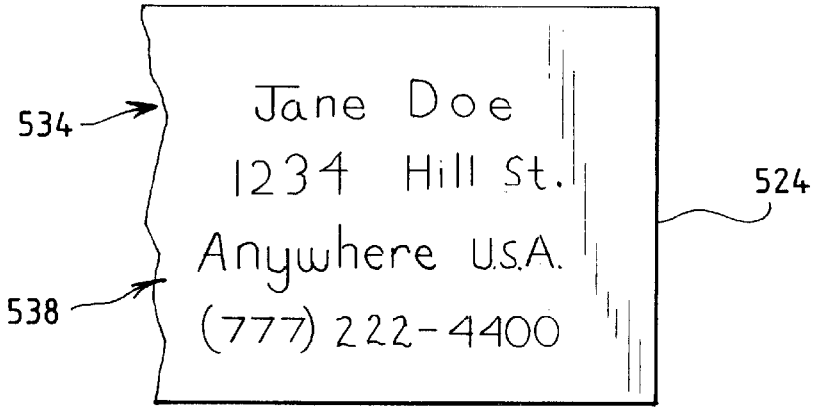
FIG. 7 is the rear face view of the sheet of paper shown in FIG. 6.

Referring how to FIGS. 5–7, there is shown another paper booklet 510 having a flexible backing member 512 including an integral cover portion 514, which is constructed in accordance with the present invention. The portion 514 covers the top of the booklet when brought into engagement with overlapped portion 516. Sheets of paper 518 are retained in paper booklet 510 by staple 520. Protective cover 522 is partially shown revealing top sheet 524 with a lipstick imprint 526 applied thereto. Paper sheet 524 is shown partially lifted to reveal the paper sheet 528 below, having a lipstick imprint 530 applied thereto. Paper sheets 518 have imprinted indicia thereon prompting the recording of the lipstick characteristics used for the lip-shaped lipstick imprint. Printed indica 532 configured in the shape of the words "NAME" and "SHADE" prompt identification of the lipstick name and the shade may be written by the user at the lower comer of paper sheet 528. Imprinted indicia prompting recording of other lipstick characteristics or other facts such as the date also can be included.

As shown in FIG. 6, there is shown a sheet of paper 534, which has been removed from paper booklet 510. A clear lip-shaped lipstick imprint 526 was applied to the paper and the paper was separated from the booklet by tearing along perforations (not shown), the remaining portion of which constitute the ragged edge 534 shown in FIG. 6. Imprinted indicia 536 for recording characteristics of the lipstick imprint are similar to the indica 532 on the sheet 528.

FIG. 7 shown the reverse or back side of page or sheet 534 removed from booklet 510 in FIG. 5. The back side of paper sheet 524 is imprinted with personal contact information indica 538 of a person such as a purchaser of the paper booklet. In this manner, the separated sheet 524 can be given to a friend or acquaintance to serve as a novel greeting or name card.

Indicia of sentimental or intriguing information can also be printed on the back of each paper sheet, or either side of the cover member or backing member. Such information is preferably of general interest to a purchaser of the booklet, including, for example, information about kissing or fashion.

The present invention includes methods and constructions for using the paper booklet of the present invention to facilitate recording lipstick usage in a convenient manner. The inventive technique includes the steps of (a) applying lipstick to the lips; (b) opening the paper booklet so as to expose a sheet of paper; and (c) kissing the sheet of paper, thereby leaving a lipstick imprint. Although usually not a problem, it is helpful that the person apply sufficient lipstick to the lips in order to have excess available to form an imprint on the paper. The present invention contemplates that the dip-printed sheets or pages remain in tact in a booklet form for record keeping purposes, but it also contemplates removing of the imprinted pages to serve as a novel reminder document or greeting card.

Thus, in accordance with the present invention, or before the clear lip-shaped lipstick imprint is made, information about the characteristics of the lipstick used to make the imprint can be recorded on the paper sheet in the location and according to the imprinted prompts. Thus, the user can record details such as the lipstick name, manufacturer, shade, as well as the date or any other information. It is preferable that only a single imprint be made per sheet or page. The user can accumulate lipstick imprints on different paper sheets in the booklet, thus employing the book as a record of past lipstick usage. Alternatively, the user can remove a sheet of paper with the lipstick imprint applied thereon and may discard it, retain it in a different location or give it to another individual such as a friend or suitor. In the latter case, the booklet can be custom manufactured so that the personal contact information of the purchaser is printed on the back side of each paper sheet.

The characteristics of the paper booklet of the present invention provides for its use as a beauty tool. Make-up artists can use the booklets or individual sheets removed therefrom to document lip colors and can maintain the sheet or booklet on file for future reference. The booklets or sheets obtained therefrom also can be used in a kissing type "board game" or may be used to form a work of "kissing" art.

While the invention has been described with reference to only a limited number of embodiments, it will be appreciated that, given the preceding disclosure and knowledge of the principles upon which the invention is based, be able to make various changes and modifications without departing from the scope of the invention which is limited only by the appended claims.

What is claimed is:

1. A small-sized booklet of paper for removing excess lipstick or for recording lipstick usage, comprising:

a backing member;

a plurality of opaque sheets of paper configure for receiving and retaining a clear lip-shaped lipstick imprint when the paper is "kissed", said paper having a gloss of less than about 50%, a basis weight of between about 40 and about 80 pounds, a brightness of reflectance of greater than about 70%, an opacity of greater than about 70%, and a caliper of between about 0.0025 and about 0.0045;

means for attaching removably said sheets of paper to the backing member;

a protective cover sheet overlaying said plurality of sheets, said protective cover sheet being non-removably attached to said backing member and being at least partially transparent; and indicia means on said plurality of paper sheets for recording characteristics of the lipstick or printed indicia of personal contact information.

2. The paper booklet of claim 1, wherein said paper has matte finish.

3. The paper booklet of claim 1, wherein said means for attaching removably is a line of perforations formed near one end of said sheets of paper, thereby facilitating tearing and removal of a paper sheet along said line of perforations.

4. The paper booklet of claim 1, wherein said paper booklet further comprises printed indicia on the backing member.

5. The paper booklet of claim 1, wherein said printed indicia of personal contact information is printed on a back surface of said plurality of sheets.

6. The paper booklet of claim 1, wherein said paper has a gloss of less than about 30%.

7. The device of claim 1, wherein said paper has a gloss of less than about 18%.

8. The device of claim 1, wherein said paper has a basis weight of between about 50 and about 70 pounds.

9. The device of claim 1, wherein said paper has a basis weight of about 60 pounds.

10. The device of claim 1, wherein said paper has a brightness of reflectance of greater than about 80%.

11. The device of claim 1, wherein said paper has a brightness of reflectance of greater than about 90%.

12. The device of claim 1, wherein said paper has an opacity of greater than about 80%.

13. The device of claim 1, wherein said paper has an opacity of greater than about 93%.

14. The device of claim 1, wherein said paper has a caliper of between about 0.0030 and about 0.0040.

15. The device of claim 1, wherein said paper has a caliper of about 0.0034.

16. A device for removing excess lipstick or for recording lipstick usage, comprising a plurality of opaque sheets of paper configure for receiving and retaining a clear lip-shaped lipstick imprint when the paper is "kissed, each of said sheets of paper being composed of papers of sufficient hardness to retain clearly a lip-shaped lipstick imprint without removing an excessive amount of lipstick from the lips of a user, said paper having a gloss of less than about 50%, a basis weight of between about 40 and about 80 pounds, a brightness of reflectance of greater than about 70%, an opacity of greater than about 70%, and a caliper of between about 0.0025 and about 0.0045;

means for attaching together removably said sheets of paper; and a protective cover sheet overlaying said plurality of sheets, said protective cover sheet being at least partially transparent.

17. The device of claim 16, wherein said paper has a matte finish.

18. The device of claim 16, wherein said sheets of paper further include printed indicia for recording characteristics of the lipstick or printed indicia of personal contact information.

19. The device of claim 18, wherein said indicia means is configured in a shape of personal contact information on a back surface of each page.

20. The device of claim 16, further including a backing member upon which the sheets are stacked.

21. The device of claim 20, further including means for enabling removal of individual paper sheets from said backing member.

22. The device of claim 21, wherein said means for enabling includes a line of perforations formed near one end of each sheet of paper.

23. The device of claim 20, further including means for attaching said sheets of paper to the backing member.

24. The device of claim 16, further including means for enabling removal of individual paper sheets from said device.

* * * * *

UNITED STATES PATENT AND TRADEMARK OFFICE

CERTIFICATE OF CORRECTION

PATENT NO. : 6,371,295 B1
DATED : April 16, 2002
INVENTOR(S) : Mayer et al.

It is certified that error appears in the above-identified patent and that said Letters Patent is hereby corrected as shown below:

Column 5,
Line 58, delete “device” and substitute -- paper booklet --

Column 6,
Lines 1, 3, 5, 7, 9, 11, 13 and 15, delete “device” and substitute -- paper booklet --

Signed and Sealed this

Sixteenth Day of July, 2002

*Attest:*

*Attesting Officer*

JAMES E. ROGAN
*Director of the United States Patent and Trademark Office*